US007401892B2

(12) United States Patent
Ha et al.

(10) Patent No.: US 7,401,892 B2
(45) Date of Patent: Jul. 22, 2008

(54) INKJET PRINTER INCLUDING SHIFTING GUIDE

(75) Inventors: Dong-Woo Ha, Suwon-si (KR); Heon-Soo Park, Seongnam-si (KR)

(73) Assignee: Samsung Electronics Co., Ltd., Suwon-Si, Gyeongg-Do (KR)

( * ) Notice: Subject to any disclaimer, the term of this patent is extended or adjusted under 35 U.S.C. 154(b) by 380 days.

(21) Appl. No.: 11/091,545

(22) Filed: Mar. 29, 2005

(65) Prior Publication Data

US 2006/0001696 A1 Jan. 5, 2006

(30) Foreign Application Priority Data

Jul. 1, 2004 (KR) ..... 10-2004-0051007

(51) Int. Cl.
*B41J 2/165* (2006.01)

(52) U.S. Cl. ..... 347/32; 347/22; 347/29

(58) Field of Classification Search ..... 347/22, 347/29, 32

See application file for complete search history.

(56) References Cited

U.S. PATENT DOCUMENTS 4,825,231 A * 4/1989 Nozaki ..... 347/30
5,467,114 A * 11/1995 Ebinuma et al. ..... 347/32
5,610,640 A 3/1997 Anderson et al.
5,760,802 A * 6/1998 Ebinuma et al. ..... 347/33
6,005,593 A * 12/1999 Yoshinaga et al. ..... 346/134
6,471,331 B1 10/2002 Silverbrook et al.
6,517,269 B1 2/2003 Scholz et al.
6,550,887 B2 * 4/2003 Therien et al. ..... 347/22
6,626,515 B2 9/2003 Silverbrook et al.
2002/0080208 A1 * 6/2002 Miyauchi et al. ..... 347/32
2005/0041059 A1 * 2/2005 Nakashima et al. ..... 347/29

FOREIGN PATENT DOCUMENTS

JP 2001-293871 10/2001
JP 2002-059558 2/2002
JP 2002-059559 2/2002
JP 2002-059561 2/2002
JP 2003-094676 4/2003

* cited by examiner

*Primary Examiner*—Manish S. Shah
*Assistant Examiner*—Mark J Stevenosky, Jr.
(74) *Attorney, Agent, or Firm*—Roylance, Abrams, Berdo & Goodman, LLP

(57) ABSTRACT

An inkjet printer is provided including a printing head which includes a nozzle unit with a length that corresponds to a width of paper to eject ink on the paper at a fixed position for printing an image. A capping unit ascends and descends between capping and uncapping positions. A guiding element is located below the printing head to support the paper and has an aperture through which the capping unit may access the nozzle unit. A moving guide moves between a first position to open the aperture such that the capping unit may be moved to the capping position and a second position to block the aperture.

17 Claims, 6 Drawing Sheets

INKJET PRINTER INCLUDING SHIFTING GUIDE

BACKGROUND OF THE INVENTION

This application claims the benefit under 35 U.S.C. § 119 (a) of Korean Patent Application No. 2004-51007, filed on Jul. 1, 2004, the entire disclosure of which is hereby incorporated by reference.

FIELD OF THE INVENTION

The present invention relates to an inkjet printer. More particularly, the present invention relates to an inkjet printer employing a printing head including a nozzle unit with a length corresponding to the width of a sheet of printing paper.

DESCRIPTION OF THE RELATED ART

Generally, an inkjet printer is an apparatus that forms an image by ejecting ink from a printing head. The printing head is separated from the upper surface of the paper and moves in a direction perpendicular to a paper transfer direction. A printing head is typically equipped with a nozzle unit having a plurality of nozzles formed therein. When the nozzle unit is exposed to air, the ink can dry, thereby blocking the nozzles. Also, dust in the air may become attached to and block the nozzles. An inkjet printer includes a capping device. The capping device is located in a capping area outside of a paper transfer area. The printing head is moved to the capping area during non-printing operations. The capping device protects the nozzle unit from contacting the air to prevent the nozzle unit from becoming dried or polluted.

Recently, instead of a printing head which moves perpendicularly to the paper transfer direction, a line head is being used for high-speed printing. The line head is a printing head which has a nozzle unit with a length corresponding to the width of printing paper. Japanese Patent Publication No. JP2002-59558, the entire disclosure of which is hereby incorporated by reference, discloses an inkjet printer including a line head. In the line head inkjet printer a printing head is substantially fixed and printing is performed by transferring the paper. Accordingly, a driving device of the inkjet printer is simple and high-speed printing can be realized. In such a printing head, a length of a nozzle unit is 210 mm in order to fit A4 sized printing paper. Accordingly, when a capping area is provided outside of a paper transfer area, the size of the inkjet printer is very large. Therefore, the capping device is provided below the printing head. Since a guiding element supporting a rear side of the paper is also provided below the printing head, the capping device is provided below the guiding element so that paper transfer is not interrupted. An aperture is provided under the nozzle unit in the guiding element so that the capping device can access the nozzle unit. While printing is performed, the paper must be horizontally supported by the guiding element. However, since the aperture is under the nozzle unit, it is difficult to stably support the paper.

Accordingly, there is a need for an improved inkjet printer that stably supports paper including a printing head which includes a nozzle unit with a length corresponding to the paper width.

SUMMARY OF THE INVENTION

An aspect of the present invention is to solve at least the above problems and/or disadvantages and to provide at least the advantages described below. Accordingly, an aspect of the present invention is to provide an inkjet printer that stably supports paper including a printing head which includes a nozzle unit with a length corresponding to the paper width.

According to an aspect of the present invention, there is provided an inkjet printer including a printing head having a nozzle unit with a length that corresponds to a width of paper to eject ink on the paper at a fixed position to print an image. A capping unit ascends and descends between capping and uncapping positions. A guiding element is located below the printing head to support the paper and has an aperture through which the capping unit can access the nozzle unit. A moving guide is movable between a first position to open the aperture such that the capping unit can be moved to the capping position and a second position to block the aperture.

Preferably, the moving guide moves horizontally, and the guiding element may further include a rotation guide rotated by the moving guide to allow the moving guide to move to the first position.

It is also preferable that the moving guide moves angularly.

It is preferable that the moving guide moves to the first and second positions in connection with the ascending and descending of the capping unit.

It is also preferable that the inkjet printer include an elastic element which provides an elastic bias to the moving guide toward the second position.

Preferably, the capping unit includes a slant portion supporting the moving guide.

It is also preferable that when the capping unit is moved to the capping position, the moving guide contacts the slant portion and moves to the first position, and when the capping unit is moved to the uncapping position, the moving guide moves to the second position due to the elastic bias of the elastic element.

Other objects, advantages, and salient features of embodiments of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, and features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for conciseness.

Figure 1:
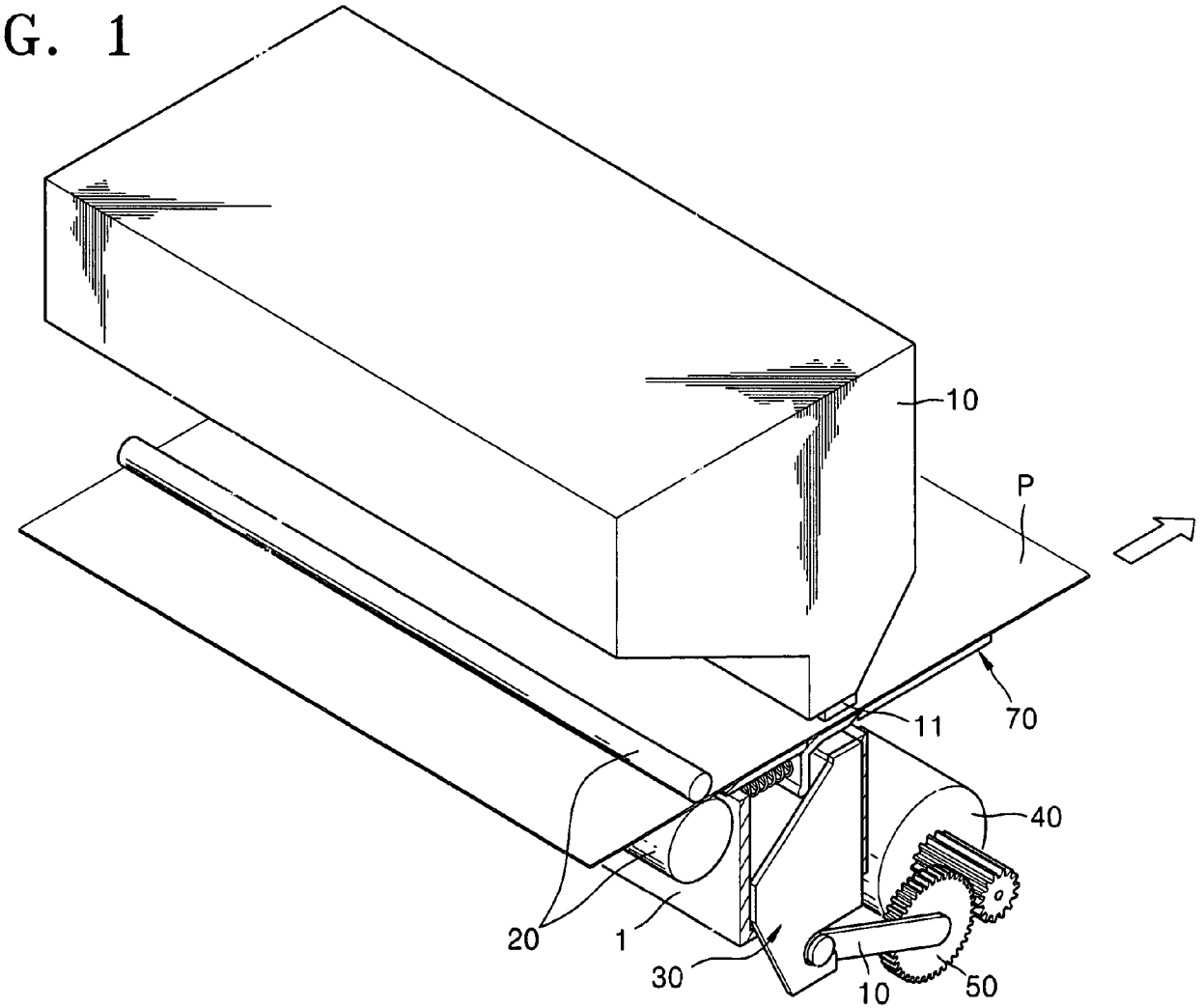
FIG. 1 is a perspective view of an inkjet printer in accordance with an embodiment of the present invention.
Figure 2:
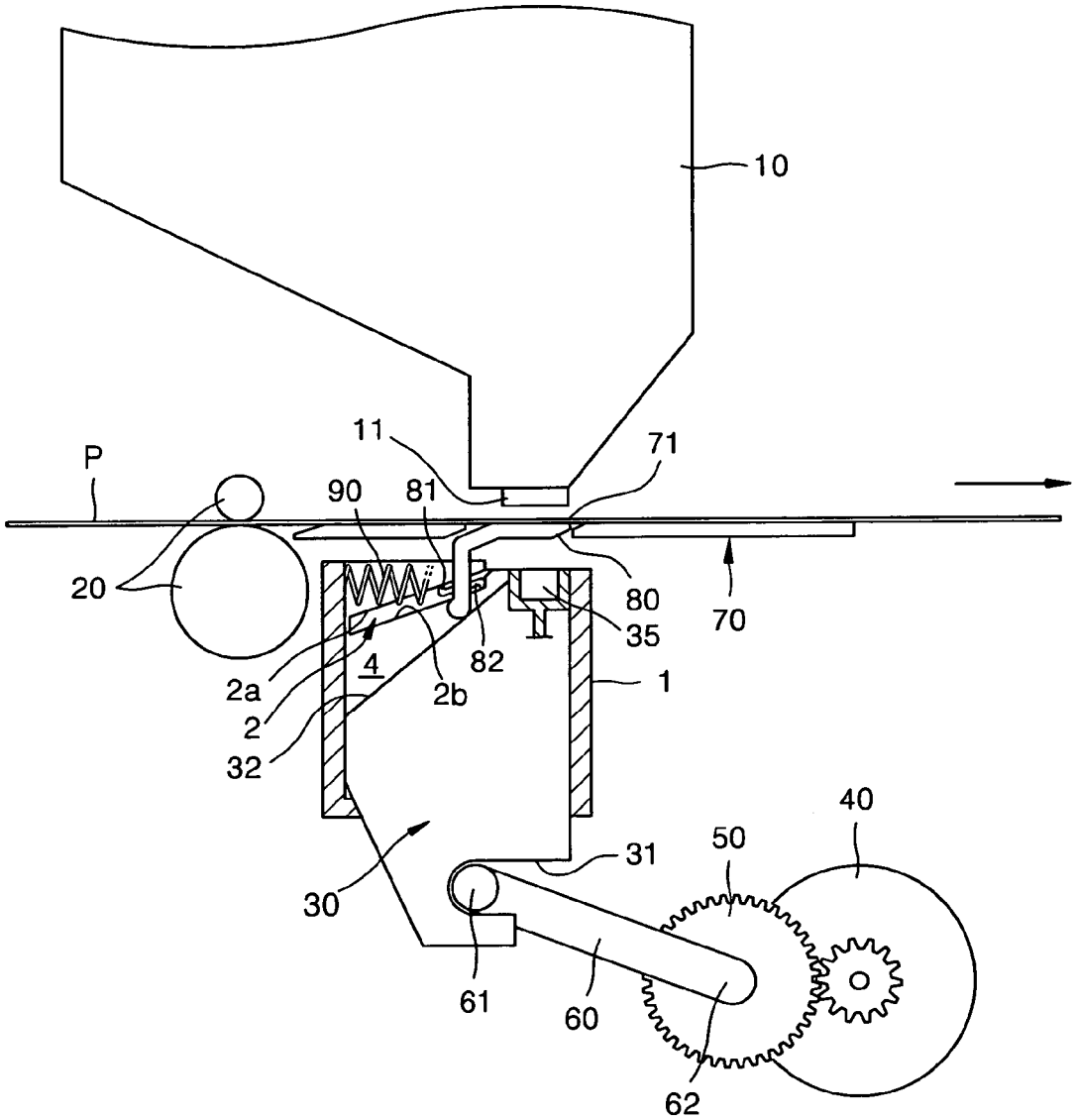
FIG. 2 is a vertical cross-sectional view of the inkjet printer of FIG. 1.

FIG. 1 is a perspective view of an inkjet printer according to an embodiment of the present invention. FIG. 2 is a vertical cross-sectional view of the inkjet printer of FIG. 1.

Referring to FIGS. 1-2, paper P is transferred by a pair of rollers 20 which are biased toward each other and rotate. A printing head 10 is installed above the paper P. The printing head 10 includes a nozzle unit 11 having a length corresponding to a width of the paper P. A guiding element 70 supports a rear side of the paper P passing below the nozzle unit 11 to maintain a fixed distance between the nozzle unit 11 and the paper P.

Figure 6A:
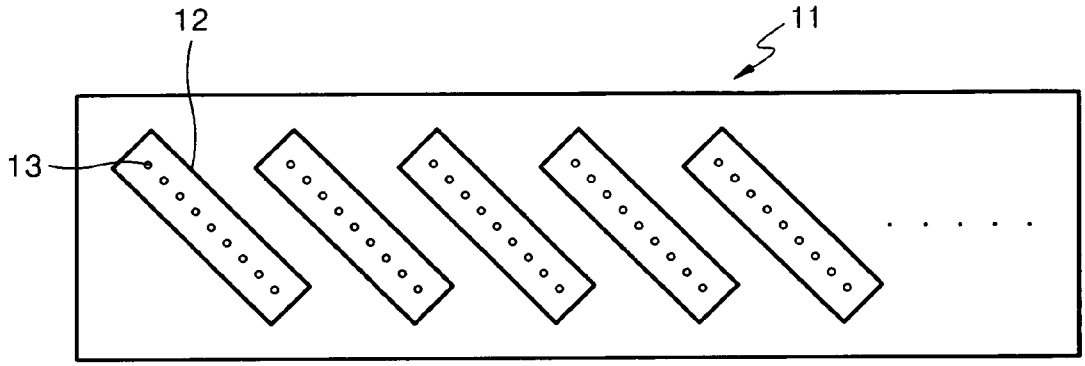
FIGS. 6A through 6C are diagrams illustrating examples of a nozzle unit of the inkjet printer shown in FIG. 1.
Figure 6B:
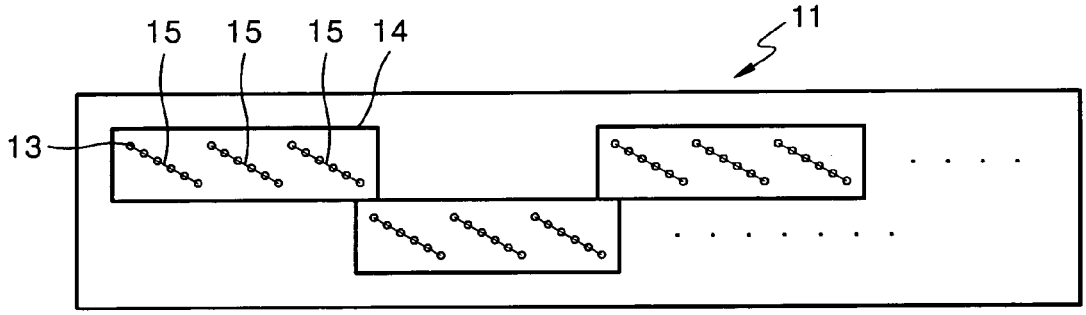
Figure 6C:
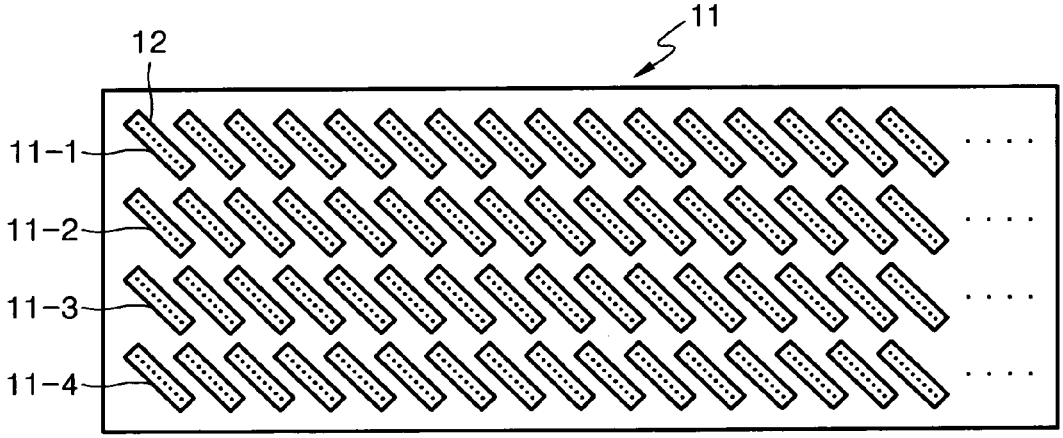

FIGS. 6A through 6C are diagrams illustrating exemplary arrangements of the nozzle unit 11. In the nozzle unit 11 of FIG. 6A, a plurality of nozzle plates 12, each having a plurality of nozzles 13 formed in a row, are disposed in a row and inclined with respect to the length of the nozzle unit 11. In the nozzle unit 11 of FIG. 6B, a plurality of nozzle plates 14, each having a plurality of nozzle lines 15 inclined with respect to the length of the nozzle unit 11, are staggered along the length of the nozzle unit 11. In the nozzle unit 11 of FIG. 6C, four nozzle sections 11-1, 11-2, 11-3, and 11-4, each including a plurality of nozzle plates 12, are arranged in the paper transfer direction. Ink of different colors, for example, cyan, magenta, yellow, and black, can be ejected by the nozzle sections 11-1, 11-2, 11-3, and 11-4, respectively. The nozzle units shown in FIGS. 6A through 6C are exemplary, and other suitable arrangements and constructions may be used.

A capping unit 30 includes at least one cap 35. The cap 35 is for capping the entire nozzle unit 11 or at least one nozzle plate 12 or 14 in order to prevent the nozzles 13 from being dried or polluted. The capping unit 30 is installed below the guiding element 70 so as to not interrupt paper P transfer. The capping unit 30 is moved to a capping/uncapping position in which the nozzle unit 11 is capped/uncapped. The capping unit 30 is contained in a housing 1. An exemplary device for moving the capping unit 30 to the capping/uncapping position is illustrated in FIGS. 1 and 2. The capping unit 30 includes a rail 31. An end 61 of a pivot 60 is inserted in the rail 31, and another end 62 of the pivot 60 is combined with a shaft of a gear 50 rotated by a motor 40. The device for elevating the capping unit 30 to the capping/uncapping position may be different from that illustrated in FIGS. 1 and 2; however, any suitable arrangements and constructions maybe used for elevating the capping unit 30 to the capping/uncapping positions shown in FIGS. 1 and 2.

The guiding element 70 has an aperture 71. The capping unit 30 is transferred to the capping position by passing through the aperture 71. A moving guide 80 is installed in the aperture 71. The moving guide 80 moves between a first position and a second position. When the moving guide 80 is located in the first position, the aperture 70 is open so that the capping unit 30 may be in the capping position. When the moving guide 80 is located in the second position, the aperture 71 is closed so that the paper P is supported. Also, the moving guide 80 may be set in the first and second positions according to the position of the capping unit 30. In the present embodiment, the moving guide 80 moves along a slant portion 32 provided in the capping unit 30. The moving guide 80 contacts the slant portion 32. A slant slot 2 is provided in a sidewall 4 of the housing 1 and may be slanted in the same direction as the slant portion 32. A slant angle of the slant slot 2 is set so that the moving guide 80 is below the guiding element 70 when the moving guide 80 is in the first position. The moving guide 80 has first and second projections 81 and 82 supported by slant walls 2*a* and 2*b* of the slant slot 2, respectively. An elastic element 90 elastically biases the moving guide 80 toward the second position.

While printing operations are performed, the capping unit 30 is located below the guiding element 70 (uncapping position) as shown in FIG. 2. The moving guide 80 blocks the aperture 71 to support the rear side of the paper P. The rollers 20 transfer the paper P. The printing head 10 ejects ink on the paper P from the nozzle unit 11 which is at a fixed position. When the printing is finished, the capping unit 30 is moved to the capping position in order to protect the nozzle unit 11 from becoming dried or polluted.

Figure 3:
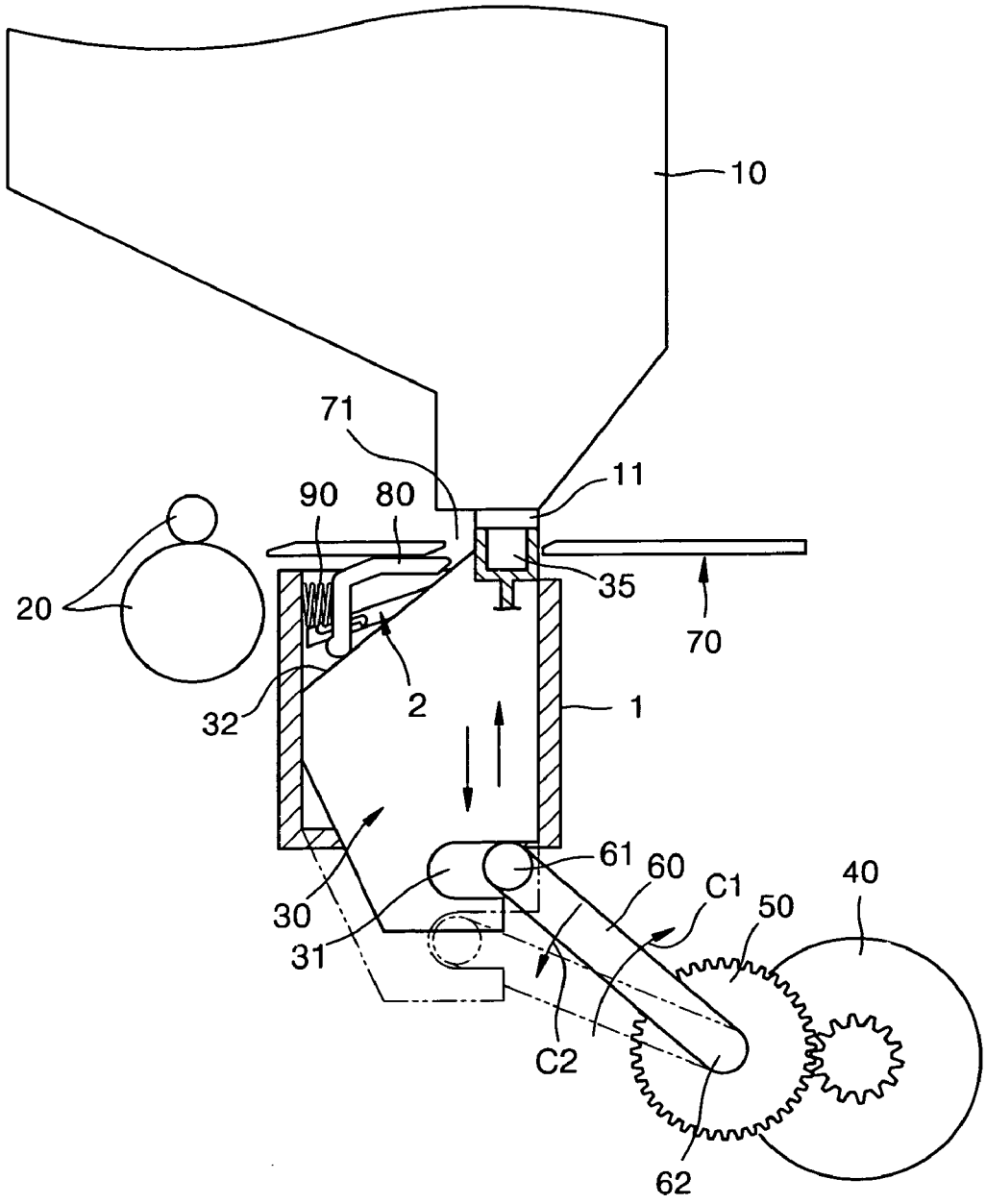
FIG. 3 is a vertical cross-sectional view illustrating the operation of the inkjet printer of FIG. 1.

Referring to FIG. 3, when the motor 40 rotates the gear 50 in a first direction C1, the pivot 60 is pivoted and pushes the rail 31. Thus, the capping unit 30 is elevated. As the capping unit 30 becomes elevated, the slant portion 32 pushes the moving guide 80. The moving guide 80 is guided downward along the slant slot 2, thereby opening the aperture 71. The capping unit 30 approaches the nozzle unit 11 via the aperture 71. The capping unit 30 caps the nozzle unit 11 to cut the nozzle unit 11 off from the air, thereby protecting the nozzles from becoming dried or polluted.

To perform printing operations, the nozzle unit 11 preferably is uncapped and the inkjet printer returns to the arrangement shown in FIG. 2. When the motor 40 rotates the gear 50 in a second direction C2 (FIG. 3), the pivot 60 is pivoted and pulls the rail 31 down, thereby lowering the capping unit 30. Thus, the moving guide 80 moves upward while keeping contact with the slant portion 32 due to the elastic bias of the elastic element 90 to block the aperture 71.

Figure 4:
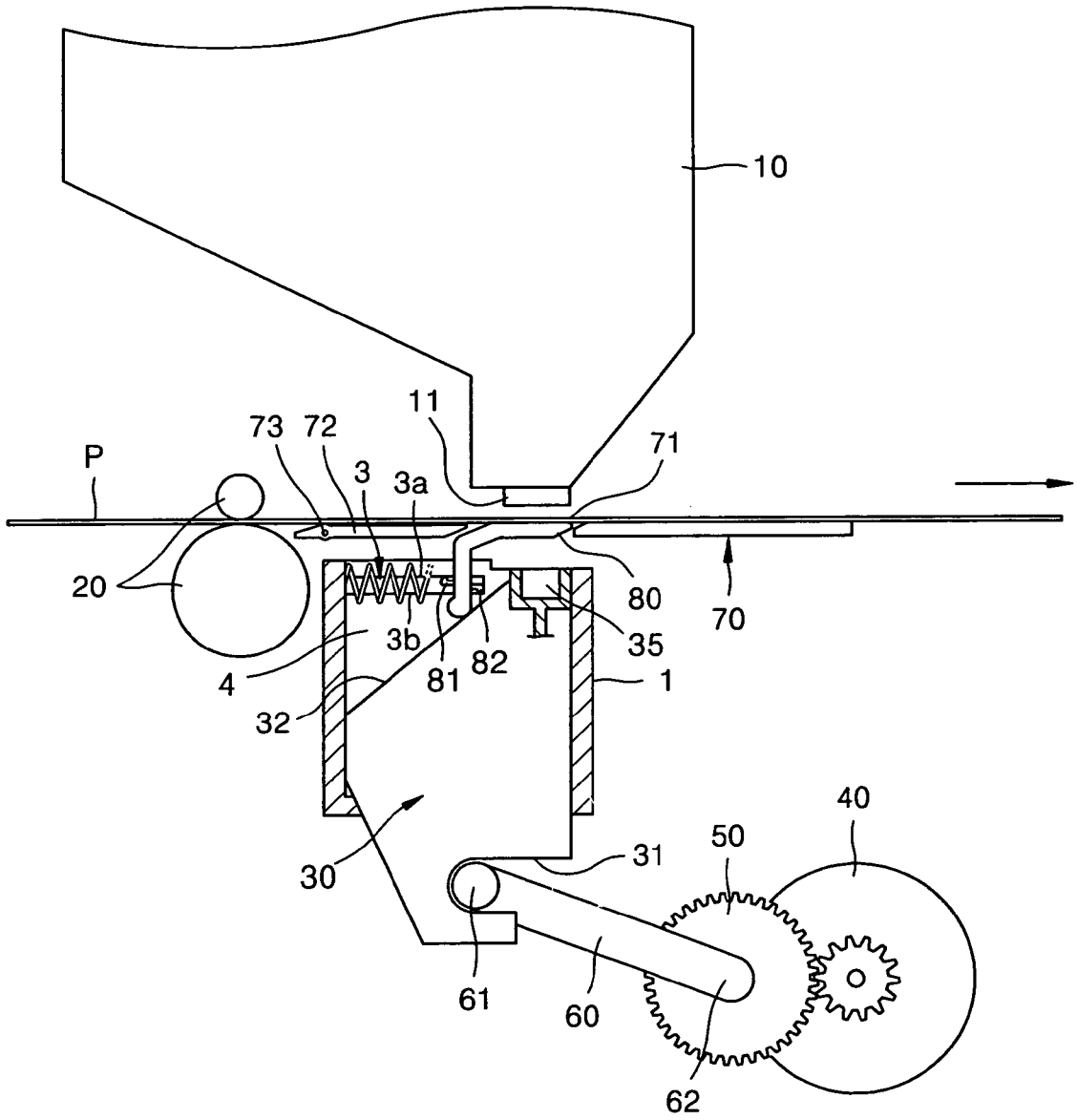
FIG. 4 is a vertical cross-sectional view of an inkjet printer in accordance with another embodiment of the present invention.

FIG. 4 is a vertical cross-sectional view of an inkjet printer according to another embodiment of the present invention. Referring to FIG. 4, the inkjet printer includes a moving guide 80 that moves horizontally. The moving guide 80 contacts a slant portion 32 of a capping unit 30. A horizontal slot 3 which extends parallel to a guiding element 70 is provided in a sidewall 4 of a housing 1. First and second projections 81 and 82 of the moving guide 80 are supported by sidewalls 3*a* and 3*b* of the horizontal slot 3, respectively. An elastic element 90 elastically biases the moving guide 80 toward a second position. The guiding element 70 further includes a rotation guide 72. The rotation guide 72 allows the moving guide 80 to move to a first position.

Figure 5:
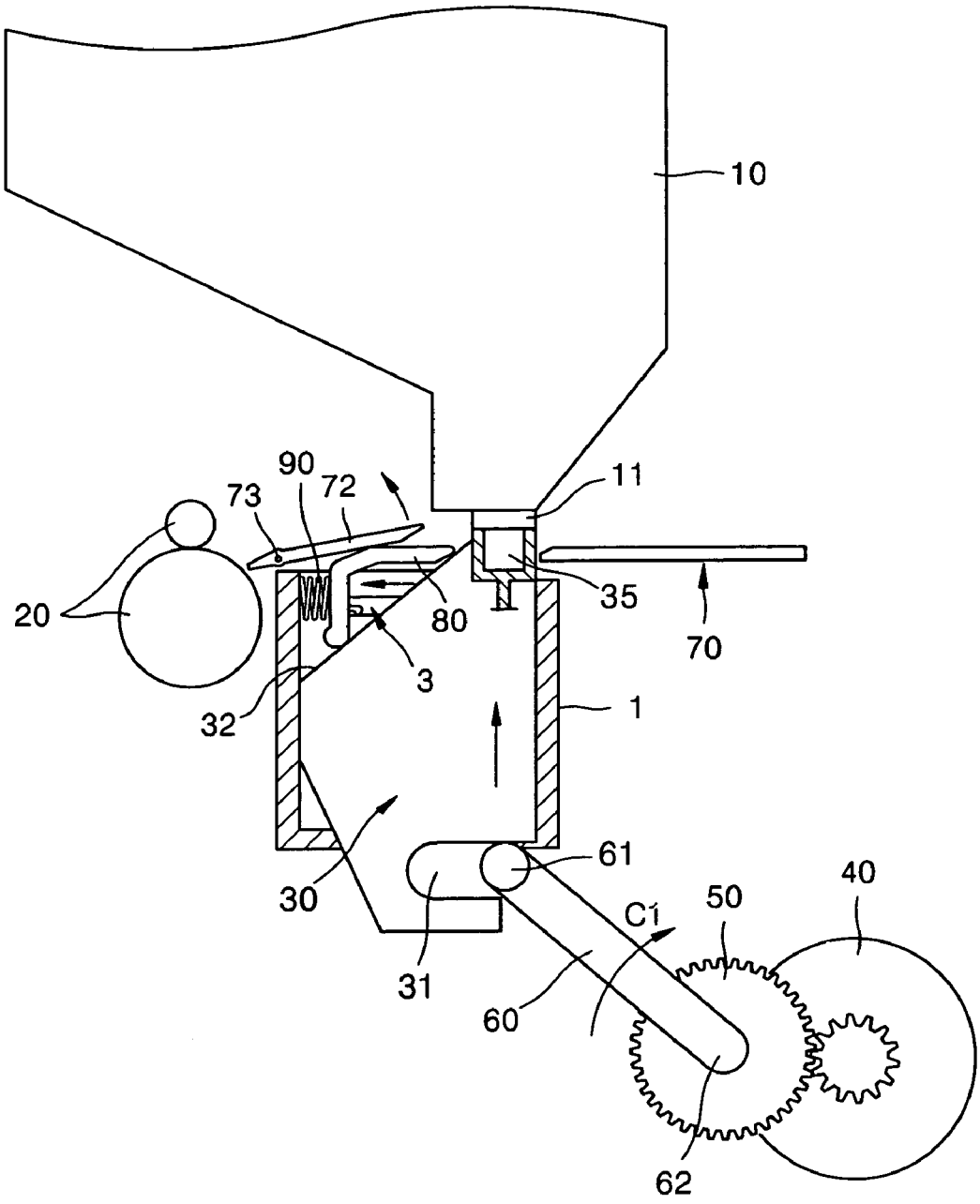
FIG. 5 is a vertical cross-sectional view illustrating the operation of the inkjet printer of FIG. 4.

Referring to FIG. 5, when a motor 40 rotates a gear 50 in a first direction C1, a pivot 60 is pivoted and pushes a rail 31 of the capping unit 30 upward, thereby elevating the capping unit 30. Therefore, the slant portion 32 pushes the moving guide 80, which is guided by the horizontal slot 3 into the first position. In this case, the rotation guide 72 is pushed by the moving guide 80 and is rotated on a hinge 73 to allow movement of the moving guide 80. Thus, an aperture 71 is opened, and the capping unit 30 approaches a nozzle unit 11 via the aperture 71. The capping unit 30 caps the nozzle unit 11 to protect the nozzle unit 11 from contacting air, thereby preventing nozzles from becoming dried or polluted.

To perform printing operations, the nozzle unit 11 preferably is uncapped. When the motor 40 rotates the gear 50 in a second direction C2 (FIG. 3), the pivot 60 is pivoted and the rail 31 lowers, thereby allowing the capping unit 30 to descend. Thus, the moving guide 80 moves to the second position along the horizontal slot 3 while keeping in contact with the slant portion of the elastic element 90. Thus, the rotation guide 72 is returned to the position shown in FIG. 4 by its own weight.

In the configuration described above, the moving guide 80 may move to the first position in which the aperture 71 is opened and the second position in which the aperture 71 is blocked according to the position of the capping unit 30.

A predetermined distance must be maintained between the paper P and the nozzle unit 11. The paper P must be supported in a flat state in order to print an image of good quality. When the inkjet printer employs a printing head 10 including the nozzle unit 11 having a length corresponding to the width of the paper P, the aperture 71 is preferably formed in the guiding element 70 supporting the rear side of the paper P such that the capping unit 30 can cap the nozzle unit 11.

Typically, when the aperture 71 is opened, the paper P cannot be supported in a flat state and the distance between the paper P and the nozzle unit 11 is changed. In the inkjet printer according to embodiments of the present invention, the moving guide 80 blocks the aperture 71 and the guiding element 70 supports the paper P in a flat state when the printing operations are performed.

As described above, in an inkjet printer according to embodiments of the present invention, a moving guide blocks an aperture such that paper is stably supported when printing operations are performed, thereby improving printing quality.

While the invention has been shown and described with reference to certain embodiments thereof, it will be understood by those skilled in the art that various changes in form and details may be made therein without departing from the spirit and scope of the invention as defined by the appended claims.

What is claimed is:

1. An inkjet printer comprising:

a printing head including a nozzle unit with a length that corresponds to a width of paper to eject ink on the paper at a fixed position for printing an image;

a capping unit, which ascends and descends between capping and uncapping positions;

a guiding element located below the printing head and contacting the paper to support the paper, the guiding element having an aperture through which the capping unit can access the nozzle unit; and a moving guide movable between a first position to open the aperture so that the capping unit may be moved to the capping position and a second position in which the moving guide substantially blocks the aperture.

2. The inkjet printer of claim 1, wherein the moving guide moves to the first and second positions in connection with the ascension and descension of the capping unit.

3. The inkjet printer of claim 2, wherein the moving guide moves horizontally, and the guiding element further includes a rotation guide rotated by the moving of the moving guide to the first position.

4. The inkjet printer of claim 3, further comprising an elastic element to provide an elastic bias to the moving guide toward the second position.

5. The inkjet printer of claim 4, wherein:

the capping unit includes a slant portion supporting the moving guide; and wherein the capping unit is moved to the capping position, the moving guide contacts the slant portion and moves to the first position, and when the capping unit is moved to the uncapping position, the moving guide moves to the second position due to the elastic bias of the elastic element.

6. The inkjet printer of claim 2, wherein the moving guide moves angularly.

7. The inkjet printer of claim 6, further comprising an elastic element to provide an elastic bias to the moving guide toward the second position.

8. The inkjet printer of claim 7, wherein:

the capping unit includes a slant portion supporting the moving guide; and wherein the capping unit is moved to the capping position, the moving guide contacts the slant portion and moves to the first position, and when the capping unit is moved to the uncapping position, the moving guide moves to the second position due to the elastic bias of the elastic element.

9. An inkjet printer comprising:

a printing head including a nozzle unit with a length that corresponds to a width of paper to eject ink on the paper at a fixed position for printing an image;

a capping unit, which ascends and descends between capping and uncapping positions;

a guiding element located below the printing head to support the paper, the guiding element having an aperture through which the capping unit can access the nozzle unit; and a moving guide movable between a first position to open the aperture so that the capping unit may be moved to the capping position and a second position in which the moving guide substantially blocks the aperture, the moving guide being located below the guiding element in the first position;

wherein the moving guide moves to the first and second positions in connection with the ascension and descension of the capping unit.

10. An inkjet printer comprising:

a printing head including a nozzle unit with a length that corresponds to a width of paper to eject ink on the paper at a fixed position for printing an image;

a capping unit, which ascends and descends between capping and uncapping positions;

a guiding element located below the printing head to support the paper, the guiding element having an aperture through which the capping unit can access the nozzle unit; and a moving guide movable between a first position to open the aperture so that the capping unit may be moved to the capping position and a second position in which the moving guide substantially blocks the aperture;

wherein the moving guide moves to the first and second positions in connection with the ascension and descension of the capping unit;

wherein the moving guide moves horizontally, and the guiding element further includes a rotation guide, rotation of which is caused by the moving of the moving guide to the first position.

11. The inkjet printer of claim 10, further comprising an elastic element to provide an elastic bias to the moving guide toward the second position.

12. The inkjet printer of claim 11, wherein:

the capping unit includes a slant portion supporting the moving guide; and wherein when the capping unit is moved to the capping position, the moving guide contacts the slant portion and moves to the first position, and when the capping unit is moved to the uncapping position, the moving guide moves to the second position due to the elastic bias of the elastic element.

13. The inkjet printer of claim 9, further comprising:

an elastic element providing an elastic bias to the moving guide toward the second position;

wherein the moving guide travels a substantially linear path between the first and second positions, the linear path forming an angle with respect to the guiding element.

14. The inkjet printer of claim 13, wherein:

the capping unit includes a slant portion supporting the moving guide; and wherein when the capping unit is moved to the capping position, the moving guide contacts the slant portion and moves to the first position, and when the capping unit is moved to the uncapping position, the moving guide moves to the second position due to the elastic bias of the elastic element.

15. An inkjet printer comprising:

a printing head, including a nozzle unit with a length corresponding to a width of paper, to eject ink on the paper at a fixed position for printing an image;

a capping unit selectively traveling between capping and uncapping positions to cap and uncap the nozzle unit, the capping unit having a slant portion;

a guiding element located below the printing head to support the paper, the guiding element having an aperture through which the capping unit travels; and a moving guide, disposed to substantially block the aperture, and moved to a position to open the aperture by the traveling of the capping unit from the uncapping position to the capping position while maintaining contact with the slant portion, the moving guide being located below the guiding element in the first position.

16. The inkjet printer of claim 15, wherein the guiding element further includes a rotation guide rotated by the moving guide as the moving guide moves to the position to open the aperture.

17. An inkjet printer comprising:

a printing head including a nozzle unit with a length that corresponds to a width of paper to eject ink on the paper at a fixed position for printing an image;

a capping unit which ascends and descends between capping and uncapping positions;

a guiding element located below the printing head to support the paper, the guiding element having an aperture through which the capping unit can access the nozzle unit;

a moving guide movable between a first position to open the aperture so that the capping unit may be moved to the capping position and a second position to block the aperture;

an elastic element providing an elastic bias to the moving guide toward the second position;

wherein the moving guide moves to the first and second positions in connection with the ascension and descension of the capping unit;

the capping unit includes a slant portion supporting the moving guide; and when the capping unit is moved to the capping position, the moving guide contacts the slant portion and moves to the first position, and when the capping unit is moved to the uncapping position, the moving guide moves to the second position due to the elastic bias of the elastic element.

* * * * *